United States Patent [19]

Legnos

[11] 4,048,941

[45] Sept. 20, 1977

[54] SEAGOING COMPOSITE BARGE-TUG VESSEL

[76] Inventor: Peter John Legnos, 973 North Road, Groton, Conn. 06340

[21] Appl. No.: 684,648

[22] Filed: May 10, 1976

[51] Int. Cl.[2] ..... B63H 28/00

[52] U.S. Cl. ..... 114/248

[58] Field of Search ..... 114/235 R, 235 A, 77 R, 114/248, 249

[56] References Cited

U.S. PATENT DOCUMENTS

| | | | |
|---|---|---|---|
| 2,369,615 | 2/1945 | Smith | 114/77 R |
| 3,557,742 | 1/1971 | Gainsley | 114/235 R |
| 3,610,196 | 10/1971 | Lowry | 114/235 R |

*Primary Examiner*—Trygve M. Blix
*Assistant Examiner*—Gregory W. O'Connor
*Attorney, Agent, or Firm*—Larson, Taylor and Hinds

[57] ABSTRACT

A composite barge-tug vessel is provided which comprises a detachable tug and barge which when brought into full engagement form an integrated vessel capable of use on the high seas. The barge includes, at the aft end thereof, a pair of spaced rearwardly extending stern fins the upper surfaces of which form inclined mating or aligning planes. The tug includes laterally extending wings whose undersurfaces form aligning planes that mate with the aligning planes of the barge, the sliding engagement between the pair of aligning planes enabling the wings of the tug to be driven up onto the stern fins of the barge. A prow tongue on the tug engages in a slot formed between the stern fins and projections at the tip ends of the stern fins engage in connection apertures formed at the sides of the tug. Wedging surfaces at the connections between the tug and barge prevent lateral movement while a wedging assembly located at the aligning planes fixes the longitudinal positions of the tug and barge.

39 Claims, 10 Drawing Figures

SEAGOING COMPOSITE BARGE-TUG VESSEL

FIELD OF THE INVENTION

The present invention relates to an integrated composite barge-tug vessel formed by a detachable barge and tub.

BACKGROUND OF THE INVENTION

A number of different approaches have been taken with regard to the problems of providing a composite sea-going barge-tug vessel wherein the tug or propulsion portion is detachable from the barge or cargo-carrying portion and wherein the tug is capable of operation as a seagoing tug. In general, these approaches fall into two classes, viz., "articulated" barge-tug vessels and "rigid-connected" barge-tug vessels. In an articulated vessel, the barge generally includes a notched or recessed aft portion which is hingedly attached to the bow of the tug. This form of detachable connection is disadvantageous because, inter alia, the barge and tug are permitted to pitch and roll independently of one another and this prevents use of the vessel at sea during unfavorable weather conditions.

The rigid-connected vessels of the prior art, while overcoming this particular disadvantage, suffer a number of important disadvantages themselves. For example, the tug, when detached from the barge, should itself be of a seaworthy design and many such detachable tugs are simply not seaworthy. Another serious disadvantage of some constructions is the complexity of the interlocking shapes which are used in connecting the barge and tug together. These complex shapes are difficult and expensive to reproduce and hence the manufacturing costs of such vessels are high. Yet another important disadvantage of the prior art is the difficulty encountered in engaging and disengaging the barge and tug.

Although, as stated, a number of different approaches have been taken, three of these such approaches will be briefly considered here for purposes of comparison. U.S. Pat. No. 3,698,349 (Stevens) discloses a seagoing barge and tug construction wherein an aft section of the barge is received between the twin hulls of a catamaran type tug. One disadvantage of this arrangement is that the forward end connection between the tug and barge does not engage enough of the barge to evenly distribute the strain. Moreover, this design includes a large number of curves and angles making the construction difficult to build. Further, because of the manner in which the barge and tug mate, substantial vertical ballasting is required to bring the two into the alignment required to bring the two into engagement.

A barge-tug construction which prevents even more complex ballasting problems in providing engagement and disengagement of the tug and barge is that disclosed in U.S. Pat. No. 3,610,196 (Lowry). More specifically, the Lowry patent discloses a segmented ship system wherein a series of keys and keyways formed respectively on a portion of the tub tongue and portions of the barge that form a mating slot, are utilized to provide interlocking between the tug and barge. The locations of the keys and keyways require that the barge and tug be ballasted such that the tongue of the tug is first raised above the portions of the barge forming the slot. The tug is then moved forward and finally dropped so that the keys engage in the keyways. This engagement operation is obviously time consuming and, as noted, requires complex ballasting. Further, the interlocking shapes disclosed in the Lowry patent are extremely complex and the construction would be very difficult to manufacture.

A third patent of particular interest here is U.S. Pat. No. 3,556,742 (Gainsley) which discloses a composite barge-tug vessel made of interlockable sections wherein the tug or propulsion unit is "plugged-in" to the aft end of the barge or cargo-carrying hull. Again, the interlocking shapes employed are complex and the tug itself is of a design which is of questionable seaworthiness. In addition, engagement and disengagement require substantial ballasting to ensure proper alignment.

Other patents disclosing combination barge-tug vessels include U.S. Pat. Nos. 3,345,970 (DeLong); 3,362,372 (Peterson); 3,417,721 (Vienna); 3,492,964 (Garcia); 3,550,550 (Fletcher); 3,613,628 (Garcia); 3,735,722 (Hooper et al); 3,756,183 (Clemence, Jr.); 3,837,315 (Giblon), although it will be understood that this listing is not, nor is it represented to be exhaustive.

SUMMARY OF THE INVENTION

In accordance with the invention, a composite "integrated" barge-tug vessel is provided which overcomes the disadvantages of the prior art. For example, the tug or propulsion portion of the vessel is of an extremely seaworthy design and, in general, the interlocking connections between the barge and tug are relatively simple as compared with the prior art. Further, the connections between the barge and tug provide optimumly located points of control and a well balanced distribution of strain. The barge and tug when in full engagement form a rugged vessel which is capable of use on heavy seas. The construction of the barge portion is relatively simple and a conventional barge could be correspondingly modified with relatively few changes and at low cost as compared with barge sections of prior art vessels. A particularly important feature of the invention is the ease with which engagement and disengagement can be effected. As will become more clear from the description which follows the barge and tug can be brought into full engagement with a minimum of ballasting in contrast to the constructions disclosed above wherein proper alignment between the tug and barge is critical before the two can be brought together into interlocking engagement.

According to a preferred embodiment thereof, the composite barge-tug vessel of the invention include a detachable barge including first and second spaced rearwardly extending stern fins each of which includes a longitudinally extending mating plane. The tug includes a pair of laterally extending wings each of which defines a longitudinally extending mating plane that is adapted to slidingly engage a corresponding mating plane of the stern fins so as to enable the tug and barge to be brought into full engagement. Advantageously, the mating planes are inclined at an angle of 0° to 45° and preferably between 5° and 20°, inclusive depending on use. A tongue and slot connection is provided between the bow of the tug and the aft end of the barge and a further connection is provided between the tip ends of the stern fins and the sides of the tug. This latter connection is preferably made by means of projections which are located at the free ends of the stern fins and which are received in connection apertures at the sides of the tug. An arrangement for restraining lateral movement between the barge and tug is provided at one, at least, of the connections referred to. Further, a means is provided for fixing the longitudinal positions of the barge and tug when the two are brought into full engagement.

The provision of the longitudinally extending mating planes referred to above enable the tug and barge to be readily brought together in full engagement. Ballasting, where required, is limited to fore and aft trimming so as to align the planes such that the uppermost mating plane can come into contact with and subsequently slide up along the lowermost mating plane. This engagement operation contrasts with that required by vessels such as that disclosed in the Lowry patent discussed above wherein ballasting is required so that the interlocking surfaces are brought into position wherein the keys of the tub overlie the keyways of the barge, and then dropped down to provide engagement.

The connections referred to above lie generally along the same plane and, as mentioned, provide control points in strategic locations which, in combination with the broad contact area provided by the mating planes, affords a balanced distribution of forces.

Other features and advantages of the invention will be set forth in, or apparent from, the detailed description of a preferred embodiment found hereinbelow.

DESCRIPTION OF THE PREFERRED EMBODIMENTS

Figure 1:
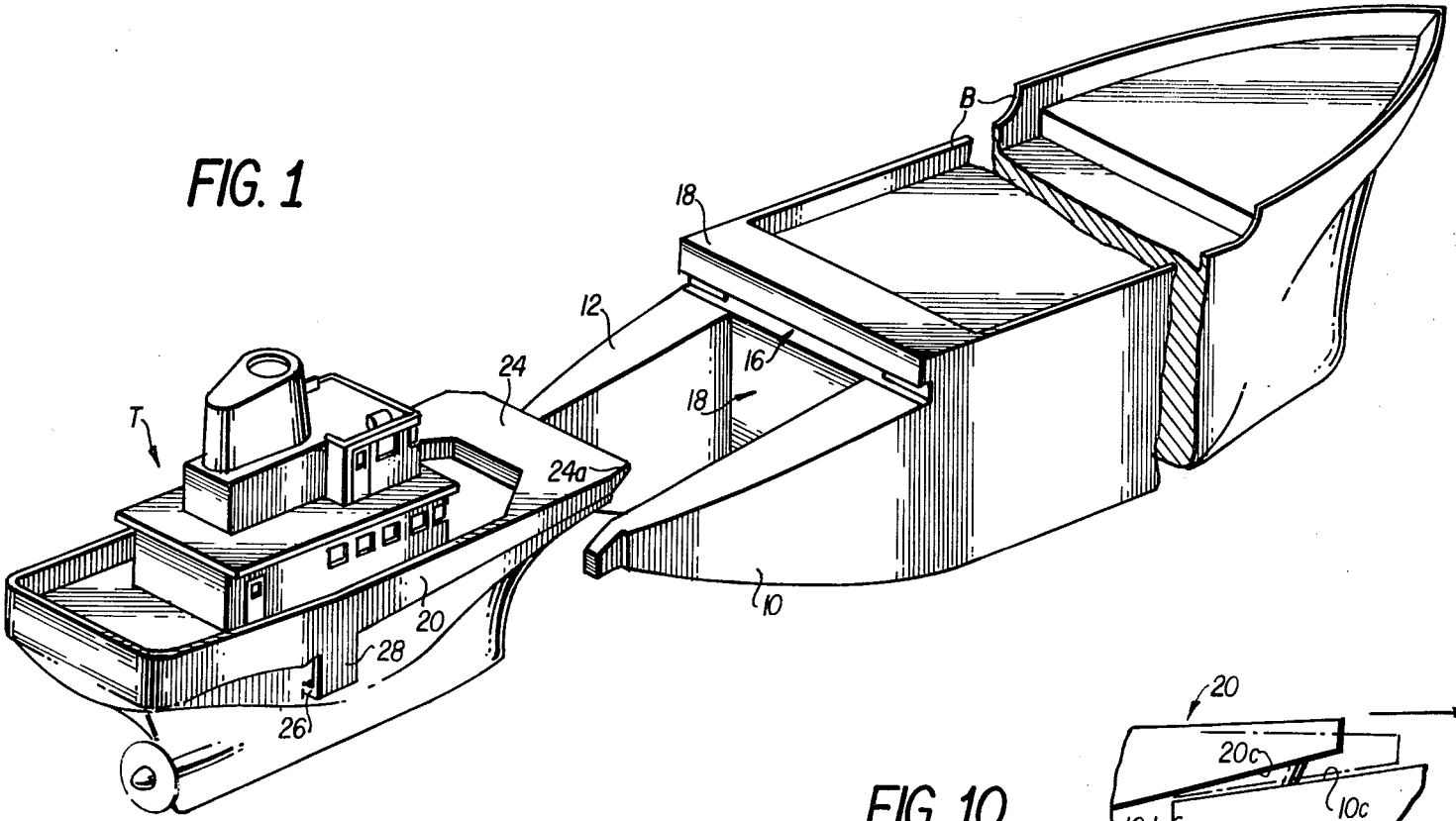
FIG. 1 is a perspective view of integral barge-tug vessel in accordance with a preferred embodiment of the invention, with the barge and tug disengaged.
Figure 2:
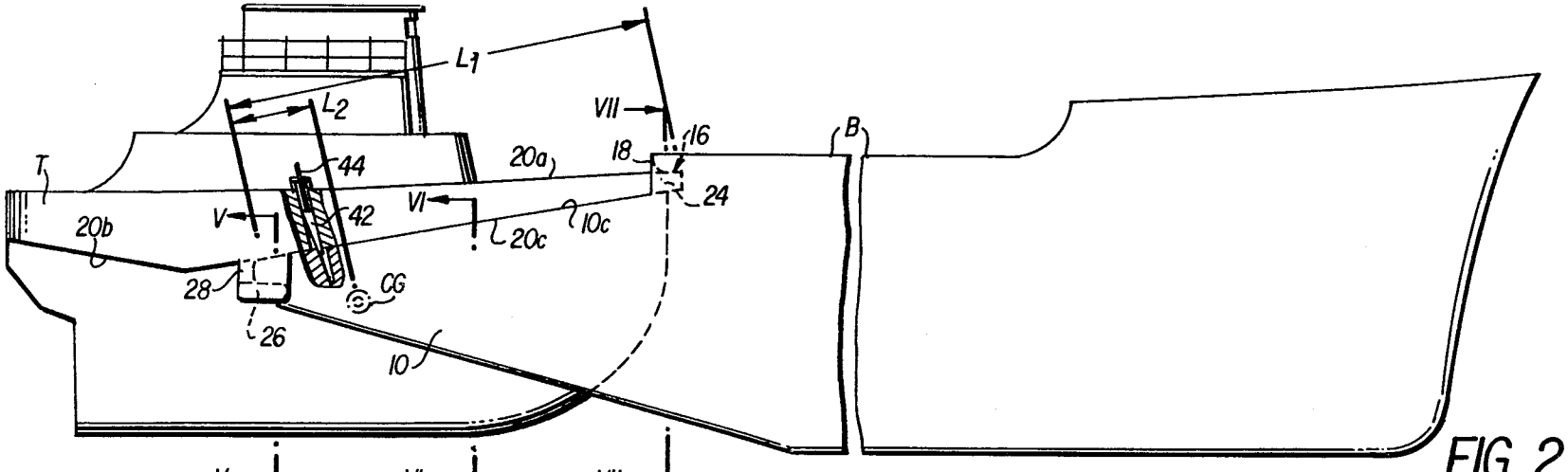
FIG. 2 is a side elevational view of the barge-tug vessel of FIG. 1, with the barge and tug in engagement.
Figure 3:
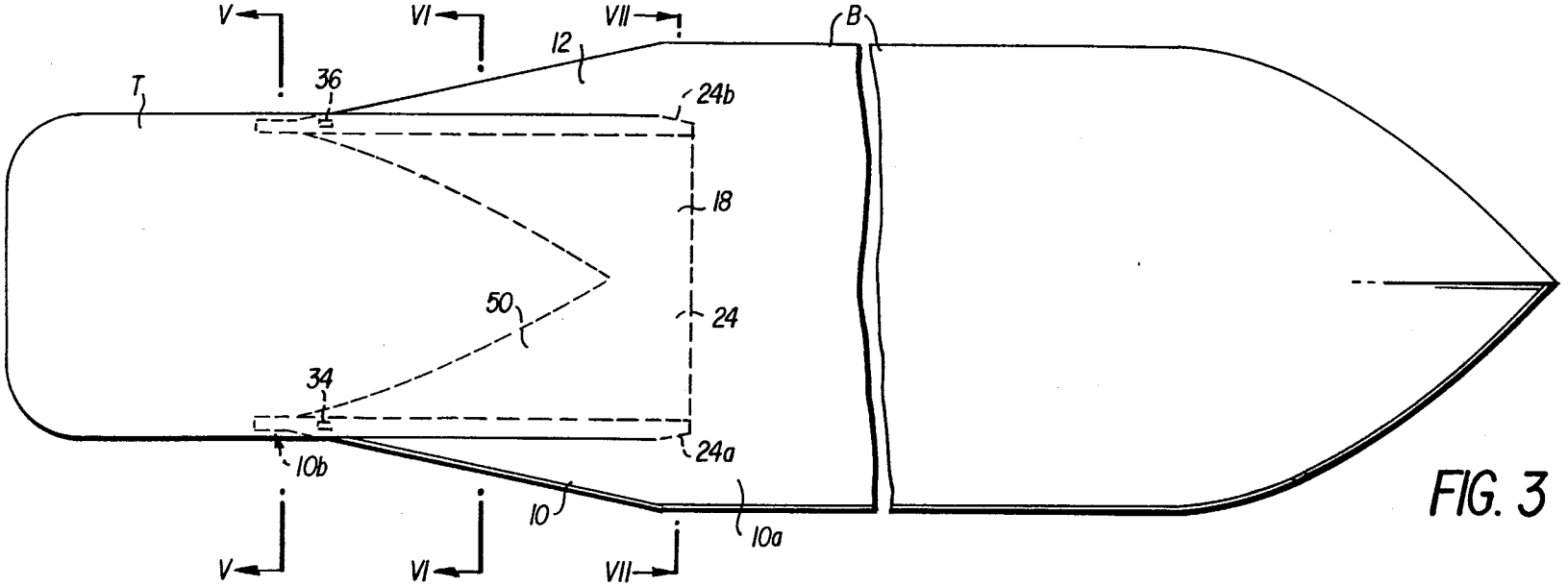
FIG. 3 is a plan view of the barge-tug vessel of FIG. 2, with constructional details of the barge and tug omitted.

Referring particularly to FIGS. 1 to 3, the integral barge-tug construction of the present invention basically comprises a tug T and a barge B which are capable of being connected together to form an integral unit as shown in FIGS. 2 and 3 as well as disengaged or detached to form separate units as shown in FIG. 1.

Figure 7:
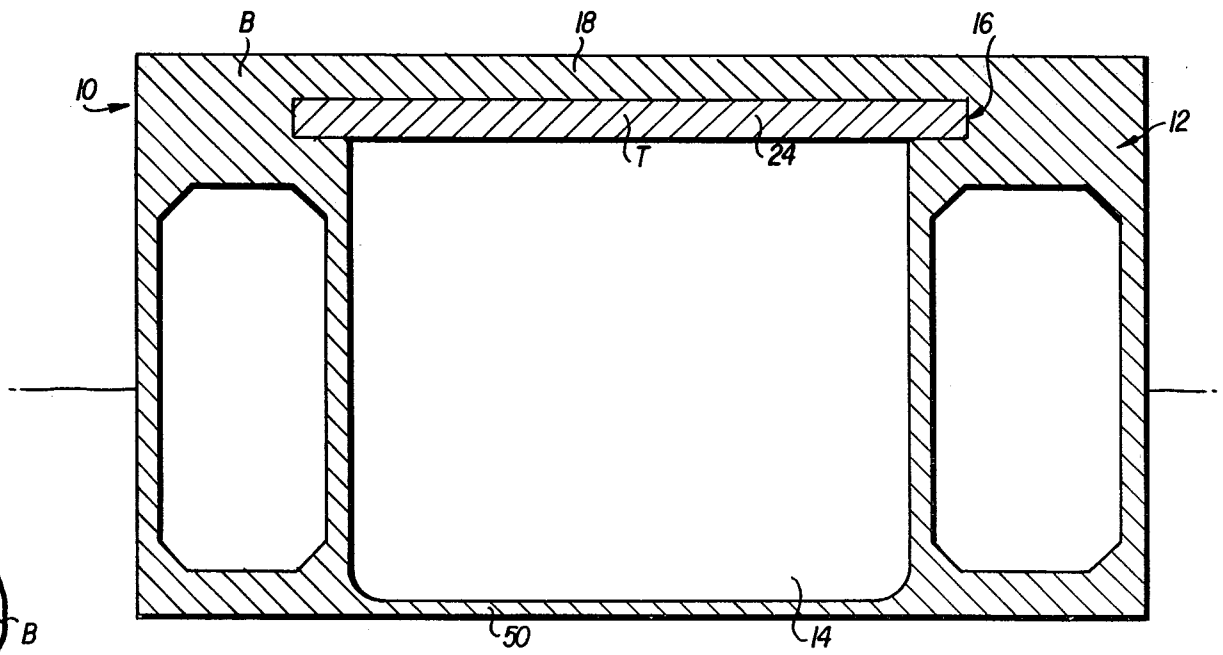
FIG. 7 is a sectional view taken generally along line VII—VII of FIG. 4 (and FIGS. 2 and 3)

Barge B is of conventional construction except for the aft end thereof and thus can take a number of common forms overall, apart from the aft end construction. At the aft end thereof, barge B includes first and second spaced rearwardly extending stern fins or projections 10 and 12. Stern fins 10 and 12 are preferably constructed of mild rolled structural steel and are of hollow cross-section as indicated in FIG. 7. As can be seen from FIGS. 1 to 3 taken together, fins 10 and 12 are the mirror images of each other, and hence only the shape of fin 10 will be considered in detail. As is perhaps best illustrated in FIG. 4, stern fin 10 tapers rearwardly in a vertical plane from the area of connection to the aft of the barge, denoted 10*a*, to the free or tip end thereof, denoted 10*b*. The inclined upper surface of fin 10 constitutes a first mating plane, denoted 10*c* and is an important feature of the invention as will be explained hereinbelow. As shown in FIG. 3, fin 10 is also tapered in a horizontal plane with the inner surface of the fin 10 extending substantially parallel to the longitudinal axis of the barge B and the outer surface being inclined inwardly from the lateral surface of the barge proper.

Figure 4:
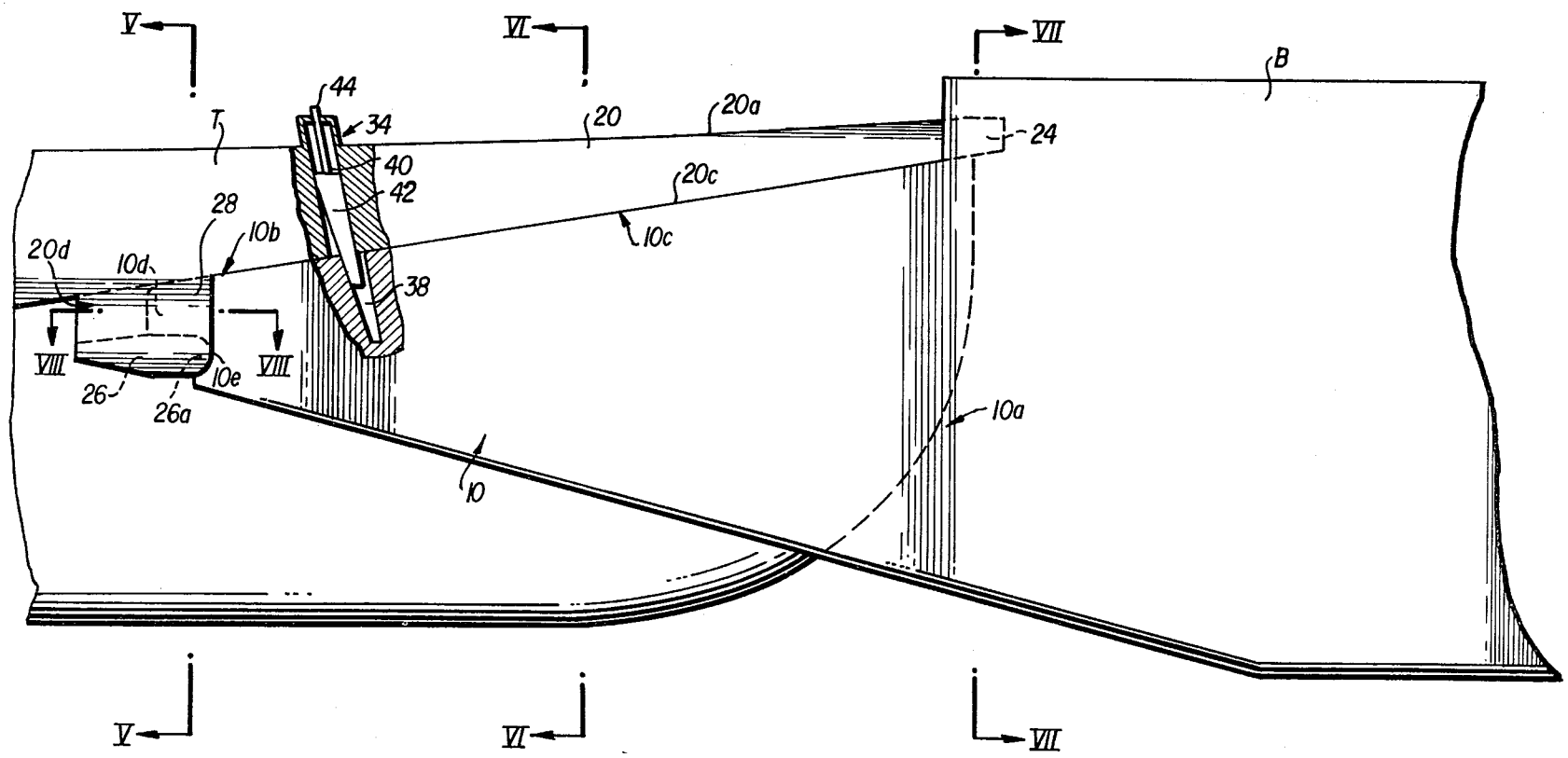
FIG. 4 is a side elevational view similar to that of FIG. 2, but to an enlarged scale.

The aft end surfaces of barge B between stern fins 10 and 12 forms a vertical plane 14 having a recess or slot 16 located near the top thereof as can best be seen in FIG. 1. Slot 16 extends the entire width of the forward end of tug T and as is shown in FIGS. 2 and 4, tapers inwardly in a vertical plane to wedgingly receive a reciprocally shaped prow tongue of the tug T as described below. As illustrated in FIG. 3, the sides of slot 16 also taper inwardly in a horizontal plane. In the illustrated embodiment, the portion of the aft end which overlies slot 16, and which is denoted 18, extends rearwardly of the vertical plane 16 a small distance so as to aid in bringing the tug T and barge B into integral engagement.

The free or tip ends of stern fins 10 and 12 are also of a specific configuration which serves in providing engagement between barge B and tug T and which will be described hereinbelow together with at least one other feature of the barge B which can best be understood in terms of its cooperation with tug T.

Tug T is of generally conventional construction apart from those features thereof which provide integral engagement between the tug and the barge. Thus, for example, the tug can be driven by a single screw or twin screws and the power plant, deck layout, and the like, can take conventional forms. As noted above, one feature of the invention is that the tug itself, when separated from the barge, is of an extremely seaworthy design, as is evident, for example, from FIGS. 1 and 4.

Figure 6:
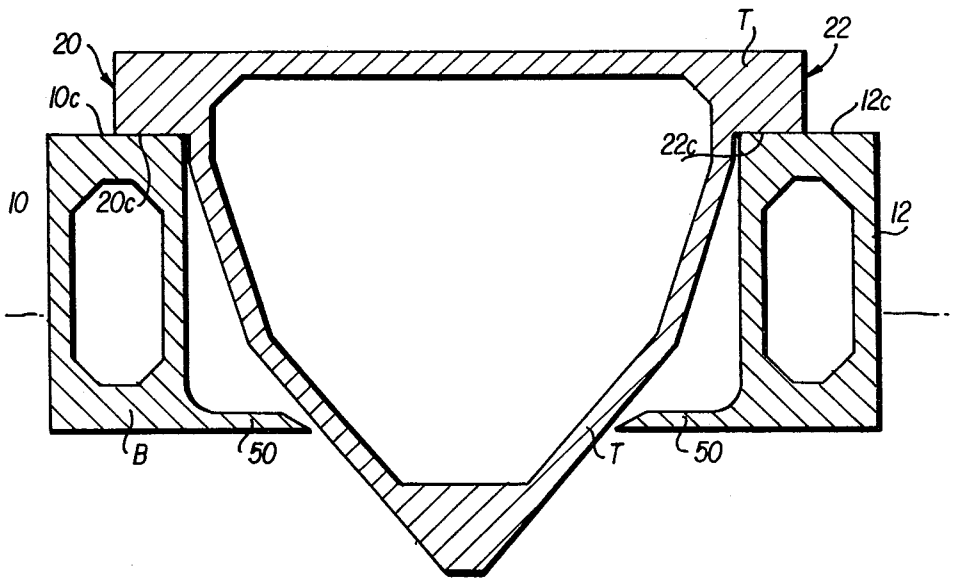
FIG. 6 is a sectional view taken generally along line VI—VI of FIG. 4 (and FIGS. 2 and 3)

In accordance with an important aspect of the construction thereof, tug T includes a pair of laterally extending wings or projections 20 and 22 which extend laterally outwardly from opposite sides of the tug and an integral forwardly extending prow tongue or extension 24 which extends outwardly from the bow of the tug T. Wings 20 and 22 are of a like configuration and only wing 20 will be considered in detail. As is perhaps best seen in FIGS. 1 and 4, while a rear portion of the upper surface of wing 20 is subtantially flat, the remainder thereof, denoted 20*a*, slopes upwardly from a point roughly three-quarters of the distance aft. A first aft portion of the undersurface of wing 20, denoted 20*b*, slopes downwardly from the aft end for a distance roughly equal to the flat portion of the upper surface while a second portion 20*c* slopes downwardly from forward end of tug T to intersect the first portion 20*b*. The continuous planar portion of the undersurface 20*c* constitutes a mating or aligning plane which is the reciprocal of, and mates with, the aligning plane constituted by the upper surface 10*c* of stern fin 10. With this arrangement, the undersurface 20*c* of wing 20 rides up on, and rests on, the upper surface 10*c* of stern fin 10 (see, in particular, FIG. 6). As discussed hereinabove, these aligning planes or surfaces serve in providing ready engagement and disengagement of the tug and barge. In general, the angles formed by these mating or aligning planes should be greater than 0° and less than 45°, depending upon the service and freeboard of the vessel, with an angle of between about 5° and 20° being preferred. The sloping upper surface of wing 20 is helpful in bringing the tug and barge into engagement as will become more evident hereinafter.

Prow tongue 20 is integral with wings 20 and 22 and extends completely across the bow end of tug T (see FIGS. 1 and 7). The shape of prow tongue 24 is the reciprocal of that of slot 16, tongue 24 being tapered in cross-section (see FIGS. 2 and 4) and including tapered side surfaces 24*a* and 24*b* (FIG. 3), so as to produce a wedging action when received in slot 16. The end surface of prow tongue 24 is preferably flat as shown but can also be rounded (radius section). It will be understood that it would be possible to reverse the locations of tongue 24 and slot 16 so that the latter would be located in the Tug T and the former on the barge B.

Figure 5:
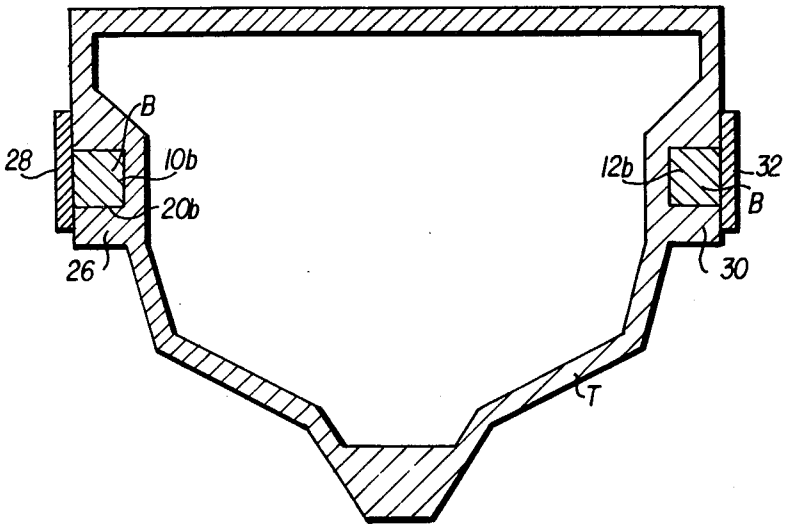
FIG. 5 is a sectional view taken generally along line V—V of FIG. 4 (and FIGS. 2 and 3)

As stated hereinabove, the tip end 10*b* of stern fin 10 is a special configuration so as to provide positive engagement with the tug T. In particular, the tip end 10*b* includes an upper connection pin or projection 10*d*, and a lower connection notch 10*e* located therebeneath (see FIG. 4). Connection pin 10*d* is received in a connection aperture 20*d* which is formed between a support member 26 and the undersurface 20*c* of wing 20. Support member 26 extends laterally outwardly from the side of tug T and is joined to wing 20 through a connecting plate 28 which is suitably affixed to both by conventional means such as bolting. A corresponding support member 30 and connecting plate 32 are located on the opposite side of the tug T (see FIG. 5). The forward end of support member 26 is shaped to form a connecting projection or nose 26*a* which is received in notch 10*e* of wing 10. Thus, a double connection between tip 10*a* of stern fin 10 and the tug T is provided by receipt of connection pin 10*d* in aperture 20*b* and receipt of nose 28*a* in notch 10*e*. It will be understood that the connection between the free end of the stern fins 10, 12 and the tug proper can take other forms and that, again, a pin and slot connection which is the reverse of that shown could be employed.

The longitudinal position of the center of gravity of tug T is located at a point forward of the tip connection of the stern fins 10, 12. Preferably, referring to FIG. 2, wherein the center of gravity is denoted CG, the distance $L_2$ between the stern fin tip connection and the center of gravity CG is at least 5% of the overall distance $L_1$ between the stern fin tip connection and the bow of the tug T.

Figure 8:
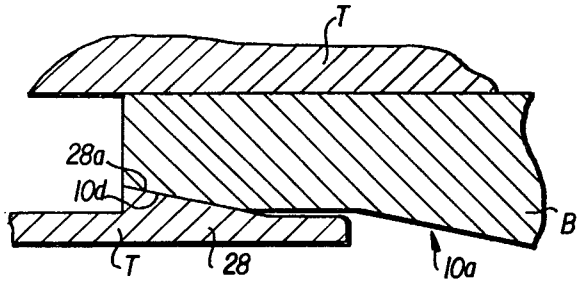
FIG. 8 is a sectional view taken generally along line VIII—VIII of FIG. 4.

To prevent relative lateral movement between barge B and tug T, aperture plate 28 is provided with an inwardly extending wedging surface 28*a* which tapers inwardly in a horizontal plane as indicated in FIG. 8. The tip end 10*a* of stern fin 10 also tapers inwardly in a horizontal plane as indicated at 20*f* so that aperture 20*d* wedgingly receives the surface 20*f*. Although not illustrated, a similar wedging action is provided between tip 12*a* of stern 12 and mounting plate 32. The lateral restraint provided by mating surfaces 20*f* and 28*a*, and the corresponding mating surfaces of connecting plate 32 and stern fin 12 (not shown), together with that provided by the wedging action of the inclined or sloping lateral edges 24*a* and 24*b* of prow tongue 24, substantially prevent relative lateral movement between the tug T and barge B when the two are brought into full engagement.

Figure 9:
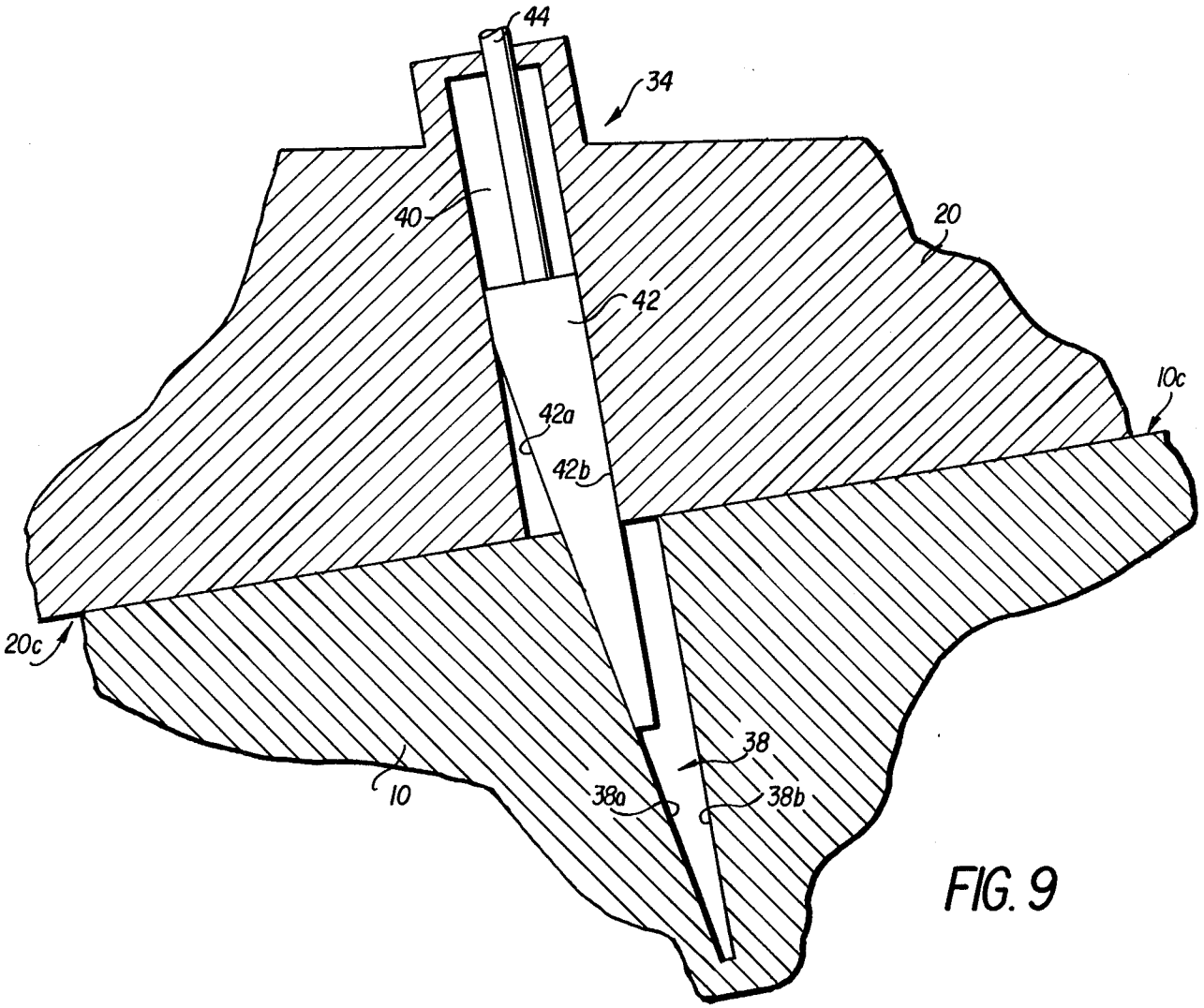
FIG. 9 is a detail, drawn to an enlarged scale, of the aligning wedge assembly, which is also shown in FIG. 4.

A pair of wedge assemblies 34 and 36 (see FIGS. 2, 4, and 9) is used to lock or otherwise fix the longitudinal positions of the tug T and barge B relative to one another. Again, considering assembly 34 as exemplary and referring particularly to FIG. 9, wedge assembly 34 includes a tapered slot or recess 38 formed in stern fin 10 and opening into the upper mating surface 10*c* of stern fin 10. Slot 38 includes an inclined wall 38*a* and a straight wall 38*b* which extends perpendicular to mating surface 10*c*. A straight slot 40 is formed in wing 20 which opens onto surface 20*c* and houses a wedge 42. The housing for wedge 42 can extend above the upper surface of wing 20, as illustrated, and wedge 42 is connected to a suitable actuator (not shown) through a connecting rod 44. An oversized fit is preferably provided between the sides of the wedge 42 and the sides of slots 38, 40 although these dimensions are not critical. The front and rear surfaces 42*a* and 42*b* and wedge 42 are matched to edges 38*a* and 38*b* of slot 38 and thus by driving wedge 42 down into slot 38, slots 38 and 40 are brought into axial alignment and the longitudinal positions of mating surfaces 10*c* and 20*c* are fixed relative to one another.

It will be seen that the wedging action provided by wedge assemblies 34 and 36 put prow tongue 24 into compression. Although these relationships are not essential, in accordance with an advantageous embodiment, the compressive forces in the direction of the longitudinal axis at the forward end of tug T, that is, at tongue 24, is greater than the vertical compressive (wedging) forces in the direction of the longitudinal axis at the tip ends 10*b* and 12*b* of stern fins 10 and 12 which is, in turn, greater than the horizontal compressive (wedging) forces transversely of the vessel provided at the tip ends 10*a* and 10*b*, i.e., between wedging surfaces 28*a* and 10*d*. To this end, prow tongue 24 can be constructed of a resilient material such as a resilient metal. As illustrated, wedge assemblies 34 and 36 are located forwardly of the tip end connections of stern fins 10 and 12 although their precise locations are a matter of design. It will be understood that the wedging assemblies 34 and 36 can be replaced by an equivalent arrangement which will (i) impart tension to the stern fins 10 and 12 and (ii) place the prow tongue 24 under compression.

In order to provide a smooth line transition between the hull of the barge B and that of tug T and, in particular, to eliminate the discontinuity that would normally exist between the stern section of the barge hull and the bow portion of the tug hull, a plate 50 is secured to the bottom of barge B. Plate 50 is bifurcated as shown in FIG. 3 so as to generally conform to the shape of the adjacent portion of the bow of the tug T and extends inwardly from the undersurface of stern fins 10 and 12 in the same plane as these surfaces (see FIGS. 6 and 7) so as to be adjacent to, but spaced from the corresponding surfaces of the bow of tug T. It will be understood that this same purpose can be accomplished in other ways and that, for example, the stern fins can be shaped and suitably faired so as to provide an even smoother transition and thus further improve the flow lines of the composite vessel.

Figure 10:
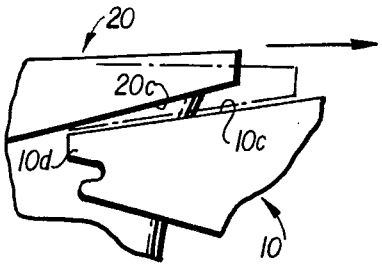
FIG. 10 is a schematic representation of the bow of the tug and aft end of the barge used in explanation of the mating operation.

Considering the operation of the composite vessel of the invention, an important feature of the invention is that the tug T can be brought into engagement with the barge B in a relatively simple manner. In this regard, one advantage of the invention is that the barge and tug may be ballasted "in trim," i.e., fore and aft, avoiding vertical ballasting, in order to provide the alignment necessary. While, in general, the tug and barge are ballasted so that the mating planes 10c and 12c of the barge B are parallel to the mating planes 20c and 22c of the tug T, the two sets of planes can be brought into contact, and the tug and barge brought into engagement, even though substantial misalignment exists. It will be understood that when, for example, portions of mating planes 20c and 22c are brought into contact with the outboard ends of stern fin mating planes 10c and 12c, the mating planes 20c and 22c can simply ride up onto the stern fin mating surfaces 10c and 12c, and even if the angle of intersection is substantial, the tug will ride up on these surfaces until the weight of the bow end causes the mating surfaces 20c,22c to automatically bear down onto mating surfaces 10c,12c. The surfaces 20c,22c will then slide simply therealong until the tug and barge are brought into full engagement. This is illustrated in FIG. 10 wherein as shown in full lines the mating plane 20c initially engages plane 10c at an angle but, as shown in dashed lines, rides therealong as the tug is drawn up further. Preferably, a lubricant is used to prevent galling between the mating planes although different metals can also be used for this purpose. It will be understood that the tug and barge can be brought into engagement using a conventional winch which can be located on either the tug or the barge. When the tug and barge are brought into engagement the wedge assemblies 34 and 36 are actuated so that the mating planes are secured in position and hence the longitudinal positions of the tug and barge are fixed.

Although the invention has been described relative to exemplary embodiments thereof, it will be understood that other variations and modifications can be effected in these embodiments without departing from the scope and spirit of the invention.

I claim:

1. A composite barge-tug vessel comprising a separable barge and tug, said barge including first and second spaced, rearwardly extending stern fins, each of said fins including means defining a continuous longitudinally extending mating plane which extends substantially the entire length of said fin, said tug including sidewalls extending from bow to stern and including first and second laterally extending wings distinct from said sidewalls, each of said wings including means defining a continuous longitudinally extending mating plane for engagement with a corresponding mating plane of said fin so as to provide sliding longitudinal contact between the mating planes of the fins and the wings such as to permit the barge and tug to be brought into full engagement, said vessel further including a first connecting means for connection of the prow end of said tug and the aft end of said barge when said tug and barge are in full engagement, a second connecting means for connecting the free ends of the stern fins to the sides of the tug when said tug and barge are in full engagement, at least one of said first and second connecting means further including means for restraining lateral movement between the barge and tug, and means for fixing the longitudinal positions of the tug and barge when said tug and barge are brought into full engagement.

2. A vessel as claimed in claim 1 wherein said first and second connecting means each include means for restraining lateral movement between said tug and barge.

3. A vessel as claimed in claim 1 wherein said first connecting means comprises a prow tongue which extends across the bow of said tug and a reciprocally shaped slot formed in the aft end of said barge for receiving said tongue.

4. A vessel as claimed in claim 3 wherein said means for restraining lateral movement comprises wedging surfaces defined by said tongue and said slot.

5. A vessel as claimed in claim 1 wherein said second connecting means comprises first and second projections formed at the outboard ends of respective ones of said fins, and means located on opposite sides of said tug defining first and second connection apertures in which respective ones of said projections are received.

6. A vessel as claimed in claim 5 wherein said means for restraining lateral movement comprises wedging surfaces defined by said projections and connection apertures.

7. A vessel as claimed in claim 5 wherein said outboard ends of said fins each include a notch therein and said connection aperture defining means each further comprise a projection which is received in a said notch when said tug and barge are in full engagement.

8. A vessel as claimed in claim 1 wherein said mating planes are inclined to the horizontal at an angle between 0° and 45°.

9. A vessel as claimed in claim 1 wherein said mating planes are inclined to the horizontal at an angle of between 5° to 20°, inclusive.

10. A vessel as claimed in claim 1 wherein the mating planes defined by said fins comprise upwardly facing, inclined, continuous smooth surfaces between the junction with the aft of the barge and the free ends of the fins.

11. A vessel as claimed in claim 3 wherein the compressive forces on said prow tongue in the direction of the longitudinal axis of the vessel are greater than the forces in the same direction at the second connecting means when the tug and barge are in full engagement.

12. A vessel as claimed in claim 11 wherein the forces exerted at said second connecting means in the direction of the longitudinal axis of the vessel are greater than the forces exerted at said second connecting means in the transverse direction when said tug and barge are in full engagement.

13. A vessel as claimed in claim 1 wherein the longitudinal location of the center of gravity of the tug is forward of the second connecting means by an amount which is at least 5% of the distance between the second connecting means and the bow of the tug.

14. A vessel as claimed in claim 1 wherein said position fixing means comprises wedging means for wedgingly connecting said mating planes.

15. A vessel as claimed in claim 14 wherein said wedging means includes a wedge shaped slot formed in one of said planes and a movable wedge which extends through the other of said planes and engages in said wedge shaped slot.

16. A composite barge-tug vessel comprising a separable tug and barge, said barge including first and second spaced rearwardly extending stern fins including generally upright sidewalls, each of said stern fins including means defining an inclined, continuous, upwardly facing mating plane, distinct from said sidewalls, presenting a single planar mating surface, and said vessel comprising first, tongue and slot connection means for connecting the prow end of said tug to the aft end of said barge, second connection means for connecting said stern fins to the beam of said tug, said second connecting means comprising first and second projections respectively located on the free end of said first and second stern fins, and means defining first and second apertures located on opposite sides of said tug for receiving said projections, and means located at one of said first and second connecting means for restraining lateral movement of between said tug and barge, said tug including first and second laterally extending wing members each including means defining an inclined, continuous, downwardly facing mating plane presenting a single planar mating surface for engaging and sliding longitudinally along a corresponding one of the single planar mating surfaces presented by the mating planes of said stern fins, so that said mating surfaces are brought into engagement and the mating surfaces of said tug slide along the corresponding mating surfaces of said barge until said tug and barge are brought into full engagement wherein the tongue of said tongue and slot connection is received in said slot and said projections are received in said aperture, and said vessel further comprising means for fixing the relative longitudinal positions of said tug and said barge when said tug and barge are brought into full engagement.

17. A vessel as claimed in claim 16 wherein said first and second connecting means each include means for restraining lateral movement between said tug and barge.

18. A vessel as claimed in claim 17 wherein said first connecting means comprises a prow tongue which extends completely across the bow to the tug and a reciprocally shaped slot formed in the aft end of said barge between said stern fins, and wherein said means at said first connecting means for restraining lateral movement comprise wedging surfaces formed at the lateral edges of said prow tongue and said slot.

19. A vessel as claimed in claim 18 wherein said means at said connecting means for restraining lateral movement comprises wedging surfaces formed by said projections and by said aperture defining means.

20. A vessel as claimed in claim 16 wherein the angle of inclination of said mating planes is between 0° and 45°.

21. A vessel as claimed in claim 16 wherein the angle of inclination of said mating planes is between 5° and 20°, inclusive.

22. A vessel as claimed in claim 16 wherein said position fixing means comprises wedging means for wedgingly connecting said mating planes.

23. A vessel as claimed in claim 22 wherein said wedging means includes a wedge shaped slot located in each of said upwardly facing mating planes and a movable wedge member which extends through each of said downwardly facing mating planes and engages in a corresponding said wedge-shaped slot.

24. An integrated tug-barge vessel comprising a separable tug having at least one hull including means defining a bow and including a prow tongue which extends across the bow thereof, first and second laterally extending wings distinct from said bow and first and second inclined, downwardly facing mating planes on opposite sides of said tug and connection means located on opposite sides of said tug and defining first and second connection apertures located adjacent the sternmost ends of said mating planes in alignment with said mating planes, and a separable barge comprising means at the aft end of said barge defining a slot which extends substantially parallel to the longitudinal axis of said barge and in which said prow tongue is received, first and second rearwardly extending stern fins located on opposite sides of said slot, said stern fins including first and second projections at the respective free ends thereof which respectively engage in the apertures defined by said first and second connection means and means defining first and second upwardly facing, inclined mating planes for longitudinally and slidingly engaging said first and second mating planes of said wings, said vessel further comprising means for preventing lateral movement between said tug and barge, and position fixing means for (i) putting said tongue member in compression within said slot and (ii) putting said stern fins in tension, so as to fix the longitudinal positions of said tug and barge.

25. A vessel as claimed in claim 24 wherein said position fixing means comprises a wedge assembly for wedgingly connecting said mating planes.

26. A vessel as claimed in claim 24 wherein said means for preventing lateral movement comprise wedging surfaces of said prow tongue and said slot.

27. A vessel as claimed in claim 26 wherein said means for preventing lateral movement further comprises wedging surfaces of said projections and said connection aperture defining means.

28. A vessel as claimed in claim 25 wherein the angle of inclination of said mating planes is between 5° to 20°, inclusive.

29. A tug adapted for use as part of a composite tug-barge vessel, said tug comprising a bow including sidewalls, a prow tongue which extends across the bow thereof and projects outwardly from the bow, first and second laterally extending wings distinct from said sidewalls and defining first and second inclined, continuous, downwardly facing mating planes so as to present a single continuous planar mating surface on each side of the tug which extends rearwardly from said prow tongue for engaging the corresponding mating planes of a barge and sliding longitudinally therealong, and connection means located at the innermost ends of said mating planes on opposite sides of said tug and defining first and second connection apertures, said tug further comprising means located at said connection means for preventing lateral movement between the tug and the barge of the tug-barge vessel, and position fixing means for fixing the longitudinal positions of the tug and barge when the two are engaged.

30. A tug as claimed in claim 29 wherein said position fixing means comprises a wedge assembly including wedges which extend through the surfaces of said mating planes.

31. A tug as claimed in claim 29 further comprising further means for preventing lateral movement comprising wedging surfaces located on said prow tongue.

32. A tug as claimed in claim 29 wherein said means for preventing lateral movement comprise wedging surfaces of said connection aperture defining means.

33. A tug as claimed in claim 25 wherein the angle of inclination of said mating planes is between 5° to 20°, inclusive.

34. A barge adapted for use as part of a composite barge-tug vessel, said barge including first and second spaced rearwardly extending stern fins each including sidewalls and means defining a continuous inclined, upwardly facing mating plane located above said sidewalls extending substantially the entire length of the corresponding said fin for slidingly engaging a corresponding mating plane of the tug of the composite vessel so as to provide sliding longitudinal contact between the mating planes, a connection slot located between said stern fins and extending across the stern fins and position fixing means for aiding in fixing the relative longitudinal positions of the barge and the tug when the two are in engagement, said slot and said projections including wedging surfaces for preventing lateral movement of the barge relative to the tug.

35. A barge as claimed in claim 34 wherein the angle of inclination of said mating planes is between 0° and 45°.

36. A barge as claimed in claim 34 wherein said first and second mating planes are inclined to the horizontal at an angle of between 5° to 20°, inclusive.

37. A barge as claimed in claim 34 wherein said position fixing means includes a wedge shaped slot formed in said mating planes and adapted to receive a movable wedge therein.

38. A tug as claimed in claim 29 wherein the angle of inclination between said mating planes is between 0° and 45°.

39. A tug as claimed in claim 29 wherein the upper interior surfaces of the apertures formed by said first and second connection means are contiguous with and constitute continuations of said mating planes.

* * * * *